US006434916B1

(12) United States Patent
Tucker

(10) Patent No.: US 6,434,916 B1
(45) Date of Patent: Aug. 20, 2002

(54) SHOCK ABSORBING ANATOMICALLY SCULPTURED SADDLE SEAT

(76) Inventor: Steven C. Tucker, 8649 Rhonda Cr. S., Cordova, TN (US) 38018

( * ) Notice: Subject to any disclaimer, the term of this patent is extended or adjusted under 35 U.S.C. 154(b) by 0 days.

(21) Appl. No.: 09/558,584

(22) Filed: Apr. 26, 2000

(51) Int. Cl.[7] ..... B68C 1/08; B68G 1/00

(52) U.S. Cl. ..... 54/44.5; 54/44.7

(58) Field of Search ..... 54/44.1, 44.4, 54/44.5, 44.6, 44.7, 66; 297/195.1, 195.11, 201

(56) References Cited

U.S. PATENT DOCUMENTS

| | | | | | |
|---|---|---|---|---|---|
| 8,064 | A | * | 4/1851 | Smith | 54/44.4 |
| 90,990 | A | * | 6/1869 | Bragg | 54/44.4 |
| 355,123 | A | * | 12/1886 | Bennett | 54/44.4 |
| 1,111,807 | A | * | 9/1914 | Adams | 54/44.7 |
| 3,153,887 | A | * | 10/1964 | Bohlin | 54/44.87 |
| 3,286,440 | A | * | 11/1966 | Walker et al. | 54/44.7 |
| 5,802,823 | A | | 9/1988 | Woods | 54/66 |
| 5,038,551 | A | | 8/1991 | Farmer | 54/66 |
| 5,048,272 | A | | 9/1991 | Saare | 54/44 |
| 5,191,752 | A | | 3/1993 | Murphy | 54/44.5 |
| 5,299,412 | A | | 4/1994 | Cudney et al. | 54/66 |
| 5,456,072 | A | | 10/1995 | Stern | 54/44 |
| 5,517,808 | A | | 5/1996 | Schleese | 54/44.6 |
| 5,799,473 | A | | 9/1998 | Goblet | 54/44.1 |
| 5,884,459 | A | * | 3/1999 | Biddlecome | 54/44.1 |
| 5,911,474 | A | | 6/1999 | Lee | 297/201 |
| 6,039,395 | A | * | 3/2000 | Culbertson | 297/195.1 |

* cited by examiner

*Primary Examiner*—Charles T. Jordan
*Assistant Examiner*—Elizabeth Shaw

(57) ABSTRACT

This invention relates to a saddle seat. This seat is adaptable to most "western" styled saddle tree and saddle jockey constructions. It is comprised of a base section that is flexible for absorbing some of the concussion related to the normal movement from a horse while being ridden. It is constructed of a single piece of flexible material of medium rigidity that attaches to the front and rear of the saddle tree, being positioned to result in it's elevation above the top surface of the saddle tree bars. It also includes a sculptured pad assembly comprising a seat padding being 2 pieces of firm padding material attaching to a saddle jockey construction to provide cushion for the riders hip bone and some elevation for clearance and relief of the riders groin, pelvic and genitalia area. Covering the sculptured and contoured seat padding is a layer of top padding and a seat cover, both being attached to a saddle jockey construction.

10 Claims, 2 Drawing Sheets

SHOCK ABSORBING ANATOMICALLY SCULPTURED SADDLE SEAT

CROSS REFERENCES TO RELATED APPLICATIONS

"not applicable"

BACKGROUND

1. Field of Invention

This invention relates to saddles for horses, specifically to an improved type of seat, which provides more comfort for the rider.

BACKGROUND

2. Description of Prior Art

This invention relates to "western" styled saddles used for riding horses and, more particularly, to the seat portion of the saddle. Although there are numerous kinds of saddles with numerous styles of seats, most saddle seats are comprised of a solid base seat section. The material used to construct the base seat section of these saddle seats is normally comprised of sheet metal, fiberglass, injection molded plastic or like material. Contour and shape alterations to the base seat section are made with layers of tapered leather or like material. This type of seat base is rigid and provides no flexibility to the rider. It also provides no means of absorbing any of the shock created by the movement of the horse during normal riding.

It is also common for saddle seats to include a top cushion comprised of various types of padding materials. This top cushion, normally covered by a soft piece of leather or like material, replicates the contour of the base seat section, creating an even or smoothly contoured surface. This smooth surface disregards the normal shapes, crevices and extrusions of the human anatomy. In summation, traditional saddle seats provide no means to absorb shock or concussion related to the normal movement from a horse while being ridden. Nor do they provide any sculptured areas, indentions, or other relief for human anatomical shapes, protrusions or genitalia.

Heretofore several attempts have been made to address the problems of saddle seat discomfort. This Inventor's own previous saddle seat base known as the "unique suspended ground seat", depicted in FIG. 3, is one such attempt. While this base saddle seat 40 provides flexibility, it suffers from a number of disadvantages. One such disadvantage is that the seat requires five pieces of leather to produce: the base section 43, two side tabs 42, and two lace assemblies 41. Also, the method of obtaining proper contour and shape with this seat requires a process that produces an undesirable bulky and bumpy top surface due to the lace assemblies 41. Moreover, this seat is very difficult and labor intensive to install.

Stern, U.S. Pat. No. 5,456,072 also relates to an attempt to soften the concussion of the horse's movement by providing a rigid saddle tree with layers of padding over it. One such layer containing a liquid impervious material and another made of gel. While this seat provides padding for the rider it still lacks a flexible base. It therefore does not provide any real shock absorption nor does it provide any sculpturing for the rider's anatomy.

Murphy, U.S. Pat. No. 5,191,752 is another attempt to soften the concussion of the horse's movement by providing a rigid saddle tree on which webbing is stretched between the cantle and head, and between the left and right frame members to provide a spring-like seat base. A covered seat cushion formed of a silicone dielectric gel is disposed on the seat. While this seat provides considerable shock absorption it represents and is limited to specific English styled saddle. This limitation disregards the broad and varied taste of horse riders.

Furthermore, Lee, U.S. Pat. No. 5,911,474 addresses the need for a more anatomically sculptured seat design in a bicycle seat. This seat design acknowledges the importance of relative anatomical sculpture; however, it has no adaptability to saddles for horses.

SUMMARY OF THE INVENTION

The present invention overcomes these shortcomings by providing a saddle that is adaptable to most "western" styled saddle tree and saddle jockey constructions. The saddle includes a base seat section that is flexible for absorbing some of the concussion related to the normal movement from a horse while being ridden and a sculptured and contoured seat padding providing cushion for the riders hip bone and elevation for some clearance and relief of the riders groin, pelvic and genitalia area.

The present invention:

(a) provides a saddle seat for horse riders that can adapt to most "western" styled tree and saddle designs;

(b) provides a saddle seat which includes a flexible base section made of a single piece of material that is easy to manufacture and will help absorb some of the shock and concussion created by the horses movement; and (c) provides a saddle seat that includes a sculptured seat padding that will provide both cushion and support for the rider's hipbones while allowing relief and clearance for the groin, pelvic and genitalia area.

Reference Numerals

Figure 1:
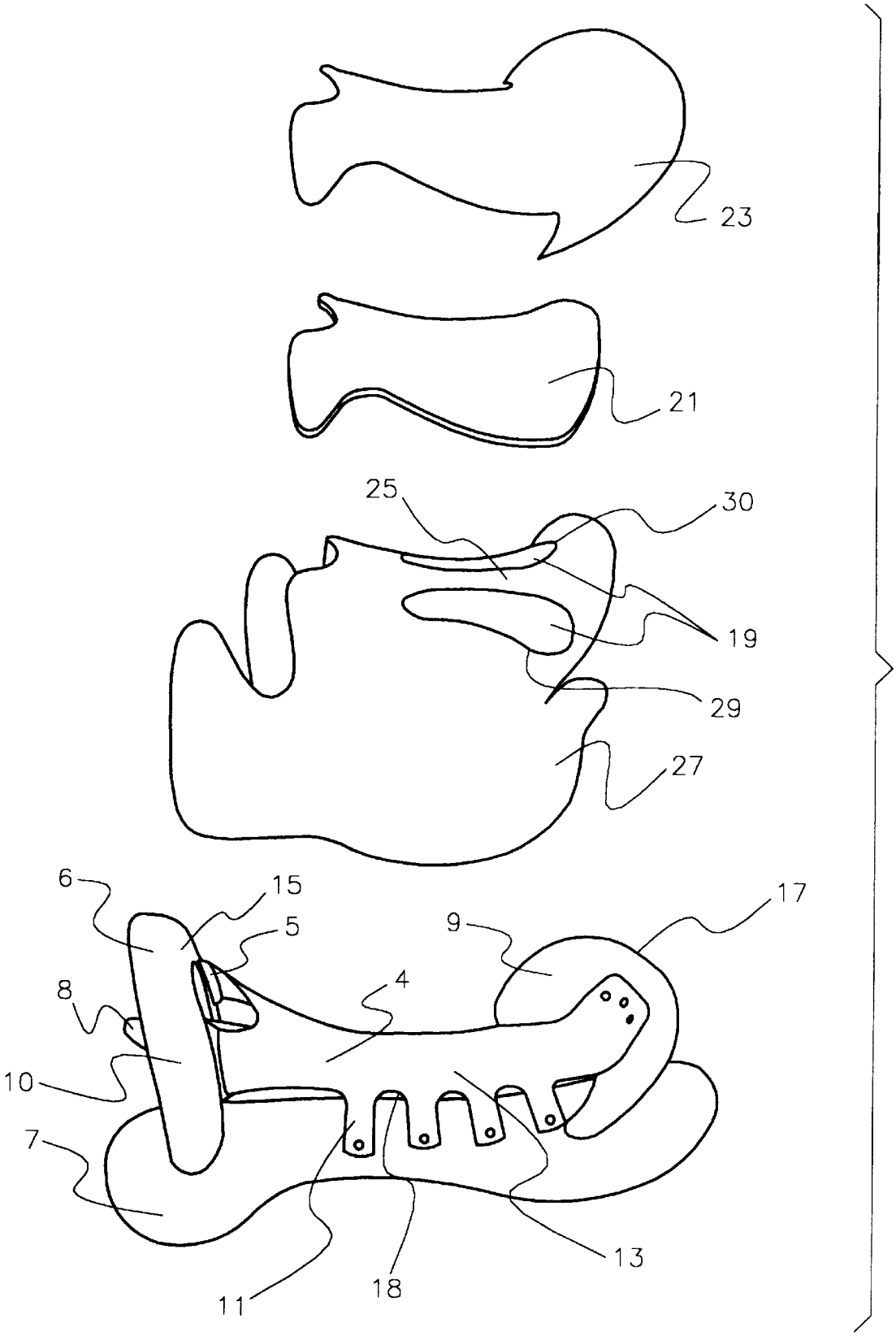
FIG. 1 is an exploded view of the saddle components, including the sculptured pad assembly.

4 base seat section
5 elevator or riser
6 front section
7 left bar
8 right bar
9 cantle
10 saddle tree
11 side tabs
13 main body
15 back center
17 front center of the top of the cantle
18 top surface
19 contoured padding
21 top padding
23 seat cover
25 clearance area
27 saddle jockey construction
29 position (a)
30 position (b)

PREFERRED EMBODIMENT

Description

Figure 2:
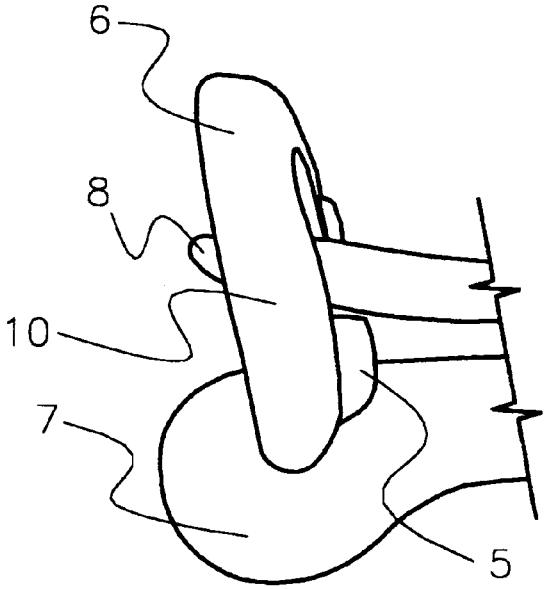
FIG. 2 is a perspective view of the front of the saddle tree without the saddle components.
Figure 3:
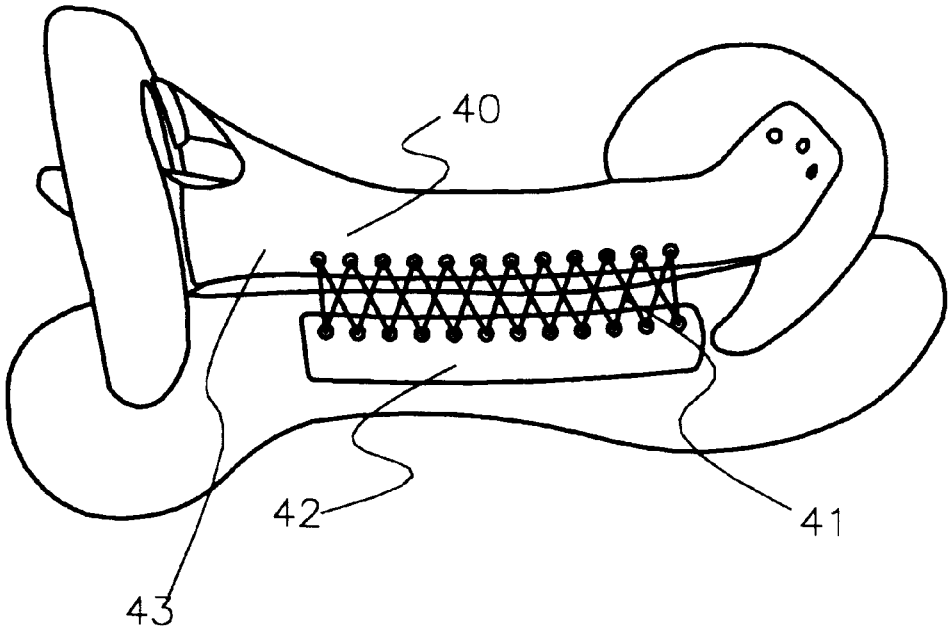
FIG. 3 is a perspective view of prior art; "unique suspended ground seat".

Referring to FIG. 1 and FIG. 2, the saddle is made up of a saddle tree 10, which includes left and right bars 7 and 8, respectively, front section 6, and rear or cantle 9. These tree components are of conventional tree materials such as wood or plastic and joined together with conventional joining means such as screws, glue, or other assembly techniques.

The base seat section 4 is a single piece of flexible material approximately ¼" thick and of medium rigidity. The base seat section 4 length relates to the saddle tree 10 dimension and determines the "seat size". The "seat size" is determined by measuring the distance between the back center 15 of the front section 6 of the saddle tree 10 and the front center of the top of the cantle 17 in a straight line. The length of the main body 13 of the base seat section 4 is 5" longer than the saddle tree 10 "seat size".

The base seat section 4 has eight side tabs 11 each being 1⅛" wide and extending 2½" in a 45 degree angle position outwardly from the main body 13 of base seat section 4 having four on each side. The side tabs 11 are spaced 1⅛" apart beginning 5½" from the front of the base seat section 4 extending rearward from the side of the main body 13. The tabs 11 are affixed to the bars 7 and 8 with nails or screws, as shown.

The base seat section 4 attaches behind the front section 6 of the saddle tree 10 on both the right and the left side on top of ¾" tall elevators or risers 5 with nails or screws. Risers 5 may be part of the original saddle tree 10 construction or added by the saddle maker. The rear of the base seat section 4 is securely attached to the rear or cantle 9 of the saddle tree 10 with nails or screws and positioned to cause the base seat section 4 to be elevated ¾" above the top surface 18 of the left bar 7 and the right bar 8. The side tabs 11 are each pulled individually and tightly to obtain the desired contour for the base seat section 4.

The saddle jockey construction 27 is configured to overlie the tree 10 and seat 4. The saddle jockey construction 27 includes a sculptured pad assembly in the form of a contoured padding 19 made of a dense padding ⅜" thick and 9" long. The contoured padding 19 includes two identical parts which each taper gradually in width from about 5" at the rear to about 1" at the front. The contoured padding 19 parts are positioned symmetrically on the right and left sides of the pocket of the saddle jockey construction 27 according to position 29 and position 30. The padding elevates the rider by extending a soft support base for the hip bones, thus providing a clearance area 25 for relief of pressure on the groin, pelvic and genitalia area.

As seen in FIG. 1, top padding 21 which is ½" soft padding, extends over the entire seat area covering the contoured padding 19 and attaching to the saddle jockey construction 27. The seat cover 23 is soft leather or like material that covers the contoured padding 19 the top padding 21 and attaches to the saddle jockey construction 27.

Operation and use of the saddle seat are as follows: The base seat section 4 is suspended from the front section 6 of the saddle tree 10 to the cantle 9 of the saddle tree 10. The base seat section 4 is attached to the front of the saddle tree 10 on ¾" tall elevators or risers 5 and is positioned to cause the base seat section 4 to be elevated ¾" above the top surface 18 of the left bar 7 and the right bar 8. The side tabs 11 are each tightly pulled and fastened to the top of the left bar 7 and the right bar 8 to obtain the desired contour for the base seat section 4. This results in the base seat section 4 providing flex and absorbing some of the concussion related to the normal movement from a horse while being ridden.

The sculptured pad assembly comprised of a contoured padding 19 provides enough height and cushion to soften some of the impact sustained by the hip bones, while creating some clearance for the groin, pelvic and genitalia. The top padding 21 which also attaches to the saddle jockey construction 27 provides a blanket of general cushion for surface comfort to the body while covering the layers of seat construction beneath. Finally, the seat cover 23, being made of soft leather or like material, is the surface material that the rider sits upon. The seat cover 23 covers all of the other seating construction and attaches to the saddle jockey construction 27.

Accordingly, it can be seen that several advantages arise from this invention. The provision of a base seat section, constructed of a single piece of material, is easy to manufacture, flexible, and absorbs some of the shock and concussion related to the normal movement from a horse while being ridden. Also, a sculptured and contoured seat padding provides cushion and support for the rider's hipbones while slightly elevating the hipbones to provide some clearance and relief to the rider's groin, pelvic and genitalia area. Furthermore, the invention has the additional advantages in that: it is adaptable to most common "western" saddle tree and saddle jockey constructions; it can be manufactured and installed with relative ease; and some variety of raw material types can be used while still achieving the same outcome.

Although the description above contains many specificities, these should not be construed as limiting the scope of the invention but as merely providing illustrations of some of the presently preferred embodiments of this invention. Various other embodiments and ramifications are possible within it's scope. For example, the base seat section could be implemented without the sculptured seat padding or conversely the sculptured seat padding could be implemented without the flexible base seat section. Thus the scope of the invention should be determined by the appended claims and their legal equivalents, rather than by the examples given.

What is claimed is:

1. A saddle comprising:

a saddle tree;

a flexible base seat section for absorbing some concussion produced by the movement of a horse through normal riding, comprising a single elongated piece of flexible material of medium rigidity having a main body and side tabs and supported on the saddle tree;

a sculptured pad assembly comprising a saddle jockey having a contoured padding and clearance area; and a top padding on the jockey and a seat cover on the top padding, wherein the rider sits on the seat cover and said contoured padding allows for elevation of the rider whereby said relief channel provides some clearance and relief for the riders groin, pelvic and genitalia area.

2. The saddle of claim 1 wherein the tree has a front section, a cantle, and left and right bars and the base seat section is positioned and attached to the saddle tree in the front section and the cantle, whereby said base seat section is elevated above the top surface of the left bar and the right bar of the saddle tree.

3. The saddle of claim 1 wherein the tree has a front section, a cantle, and left and right bars and the base seat section has side tabs attached to the left bar and the right bar of the saddle tree.

4. The saddle of claim 1 wherein the contoured padding and clearance area is positioned on top of the saddle jockey construction.

5. The saddle of claim 1 wherein the contoured padding is positioned so that a rider's hip bones, when normally seated, are each supported by the contoured padding.

6. The saddle of claim 1 wherein the contoured padding is positioned so that a clearance area is formed to align with and beneath the position of a normally seated rider's groin, pelvic and genitalia.

7. The saddle of claim 1 wherein the top padding extends over the contoured padding and clearance area and is attached to the saddle jockey construction.

8. The saddle of claim 1 wherein the seat cover covers the top padding and is attached to the saddle jockey construction, providing a sitting surface for the rider.

9. A saddle comprising:

a saddle tree;

a flexible base seat section for absorbing some concussion produced by the movement of a horse through normal riding, itself comprising a single elongated piece of flexible material of medium rigidity having a main body and side tabs and supported on the saddle tree, whereby said base seat section itself functioning independently from any sub-supporting springs or devices.

10. A saddle comprising:

a saddle tree;

a base seat section supported on the saddle tree;

a sculptured pad assembly comprising a saddle jockey having a contoured padding and clearance area, a top padding on the jockey, and a seat cover on the top padding; wherein the rider sits on the seat cover and said contoured padding allows for elevation of the rider whereby said relief channel provides some clearance and relief for the riders groin, pelvic and genitalia area.

* * * * *